US007849804B2

(12) United States Patent
Shields

(10) Patent No.: US 7,849,804 B2
(45) Date of Patent: Dec. 14, 2010

(54) STACKABLE, NESTABLE AND GANGABLE TABLE

(75) Inventor: Michael R. Shields, Greensboro, NC (US)

(73) Assignee: Ditto Sales, Inc., Jasper, IN (US)

( * ) Notice: Subject to any disclaimer, the term of this patent is extended or adjusted under 35 U.S.C. 154(b) by 811 days.

(21) Appl. No.: 11/533,400

(22) Filed: Sep. 20, 2006

(65) Prior Publication Data

US 2008/0066659 A1 Mar. 20, 2008

(51) Int. Cl.
*A47B 7/00* (2006.01)

(52) U.S. Cl. ..... 108/91; 108/50.01

(58) Field of Classification Search ..... 108/29, 108/91, 92, 93, 94, 95, 96, 90, 53.1, 53.3, 108/53.5; 211/90.03, 106, 119, 123, 126.8, 211/126.9, 126.11, 126.12, 133.1, 133.5, 211/194, 181.1

See application file for complete search history.

(56) References Cited

U.S. PATENT DOCUMENTS

| | | | | | |
|---|---|---|---|---|---|
| 1,754,199 | A | * | 4/1930 | Gibson | 108/91 |
| D153,909 | S | * | 5/1949 | Wais | D6/483 |
| 2,657,965 | A | * | 11/1953 | Bargen | 108/161 |
| 2,762,669 | A | * | 9/1956 | Watson | 108/91 |
| 2,842,412 | A | | 7/1958 | Mackintosh | |
| 2,871,073 | A | | 1/1959 | Swanson | |
| 2,894,561 | A | * | 7/1959 | Mackintosh | 297/172 |
| 3,205,839 | A | * | 9/1965 | Norreklit | 108/91 |
| RE26,071 | E | | 8/1966 | Rowland | |
| 3,326,148 | A | | 6/1967 | Jakobsen | |
| 3,408,965 | A | | 11/1968 | Hamilton | |
| 4,067,606 | A | * | 1/1978 | Desmoulins nee Fouchereau et al. | 297/141 |
| 4,646,655 | A | * | 3/1987 | Robolin | 108/92 |
| 4,648,653 | A | | 3/1987 | Rowland | |
| 5,357,873 | A | * | 10/1994 | Hilton | 108/50.01 |
| 5,613,448 | A | | 3/1997 | Petty | |
| 5,848,822 | A | * | 12/1998 | Wu | 297/344.18 |
| 6,085,669 | A | | 7/2000 | Marchand | |
| 6,374,754 | B1 | * | 4/2002 | Chang | 108/92 |
| 6,759,747 | B2 | | 7/2004 | Chan | |
| 2008/0105169 | A1 | * | 5/2008 | Chen | 108/93 |

OTHER PUBLICATIONS

Tutor Hower, product brochure, Mandal Alle 23, 5500 Middelfart, Denmark, www.howe.com, 2004.

* cited by examiner

*Primary Examiner*—José V Chen
(74) *Attorney, Agent, or Firm*—Maginot, Moore & Beck LLP

(57) ABSTRACT

A stackable, nestable, and gangable table for use in varied environments such as classrooms, conferences, testing, etc includes a wire frame scaled according to the anticipated use, a table top and a modesty panel angled obtusely from the table top to accommodate stacking and/or nesting of the tables. The table further includes glide members on the wire frame base that accommodates the ganging of tables next to one another. The glide members are mounted on the base in such a manner that they engage the opposing glides on the aligned consecutive table. The table also includes a mounting mechanism for mounting accessories such as a side storage pouch to provide additional storage and help delineate the personal work space of each table.

13 Claims, 14 Drawing Sheets

STACKABLE, NESTABLE AND GANGABLE TABLE

FIELD OF THE INVENTION

This invention relates generally to the field of tables and more particularly to wire tables that can be nested, stacked or ganged.

BACKGROUND OF THE INVENTION

For many facilities such as schools, hotels, convention centers, churches, and offices it is desirable to utilize rooms and spaces in an efficient manner. At different times, these facilities will often need to use the same space for different purposes. Some activities require the use of furniture such as tables or desks, while at other times, furniture is not needed. These facilities will often move, rearrange, or eliminate the furniture in a room according to the needs of the event. In many instances, these facilities utilize desks or tables for such events as training, test administering, lectures, speeches, conventions, etc. When the furniture is not in use at these facilities it is desirable to minimize the floor space required to store these items.

The desire to utilize spaces for different activities also presents the need to arrange furniture for various applications. Very often, arranging the furniture is cumbersome, time consuming and labor intensive. Similarly, providing an aesthetically pleasing arrangement often requires additional time, effort, and labor.

The tables and desks used in these facilities come in many varieties adapted for many uses. In an effort to reduce the floor space required for storage, some tables and desks are stackable, nestable or gangable, while some are collapsible. One type of nestable table is represented in U.S. Pat. No. 3,326,148 to Jakobsen. This table includes a table top supported by four legs. The distance between one pair of legs is greater than the distance between another pair of legs to accommodate the nesting of the tables when stacked one on top of the other. The tables also include a glide extending along two opposite edges of the table to create a gap between each stacked table to facilitate separation of the stacked tables. Another example, U.S. Pat. No. 6,085,669 to Marchand et al., depicts a table top hinged to a frame of which the legs of the table are also attached. This hinge allows the table top to be rotated to a vertical position to accommodate a horizontal nesting of the tables.

Such tables provide a marginal space savings when stored. Such tables are often heavy and difficult to move or arrange. This presents problems for the facility that needs to provide accommodating facilities with a minimal investment of time and labor.

There is a need, therefore, for a stackable table that can accommodate a multitude of uses and which can be arranged and moved with minimal effort and time required. There is also a need to provide an aesthetically pleasing arrangement without requiring extra time and labor. Optimally, the table would be simple to maneuver and arrange. There is a further need for a stackable table that encumbers minimal floor space while in storage.

SUMMARY OF THE INVENTION

In order to address these needs, the present invention provides a stackable, nestable and gangable table which includes a work surface and a modesty panel supported by a wire frame base. The frame, work surface and modesty panel are configured so that a plurality of like-configured tables may be stacked and/or nested. The modesty panel is angled vertically from the top surface, such as at 92 degree angle in one specific embodiment. This angle allows for stability when the tables are nested and stacked together. The work surface may contain a recessed area to provide a "spill proof" or "spill resistant" design.

In another aspect of the invention, the wire frame defines one or more openings that are configured to allow accessories to mount within the opening. In one embodiment of the invention, the accessory mounted into the opening is a pouch carrier or receptacle that provides storage space for items while leaving the work surface unencumbered. The pouch includes a frame with the receptacle secured to the frame and a cantilever mounting arm that is configured to mount within the opening on the table. The accessory frame is configured so that the accessory, such as the pouch, may be situated between adjacent ganged tables without interference.

In yet another aspect of the invention, glide members may be attached to the base of the table. In a specific embodiment, the glide members include a portion that is generally trapezoidal in shape which form a "dovetail" joint when juxtaposed with another glide member when adjacent tables are ganged together. The glide members not only facilitate ganging of the tables, they also prevent relative movement between adjacent tables.

It is one object of the invention to provide a wire table that may be nested and/or stacked. A further object is to provide such a table that includes not only a work surface but also a modesty panel.

A further object resides in features of the invention that allow for various accessories to be removably supported on the gangable and/or stackable table. This object is beneficially achieved while avoiding interference between the accessories and an adjacent ganged table.

One significant benefit of the present invention is that it provides a wire table that is easily stacked and/or ganged. Other objects and benefits of the invention will become apparent upon consideration of the following written description and accompanying figures.

DETAILED DESCRIPTION OF THE PREFERRED EMBODIMENT

Figure 1:
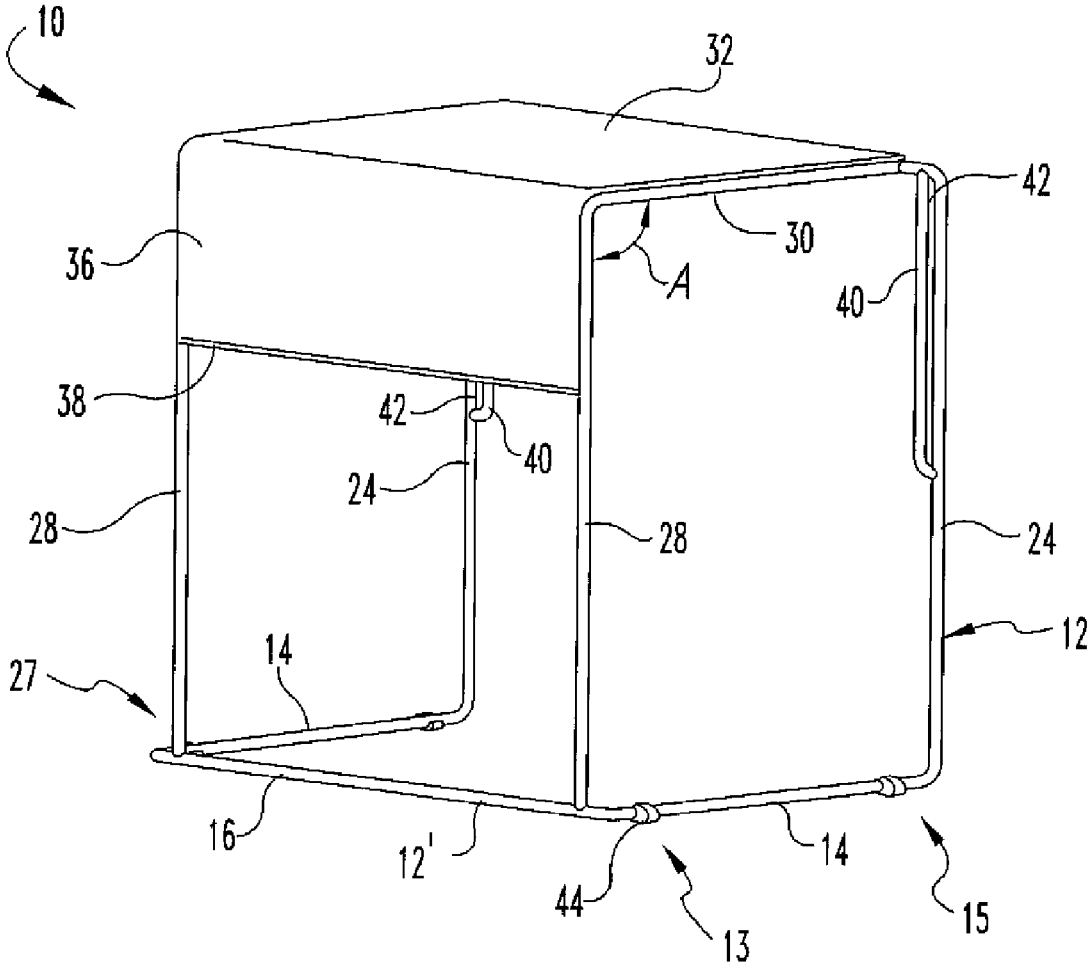
FIG. 1 is a front perspective view of a wire frame table according to one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 16:
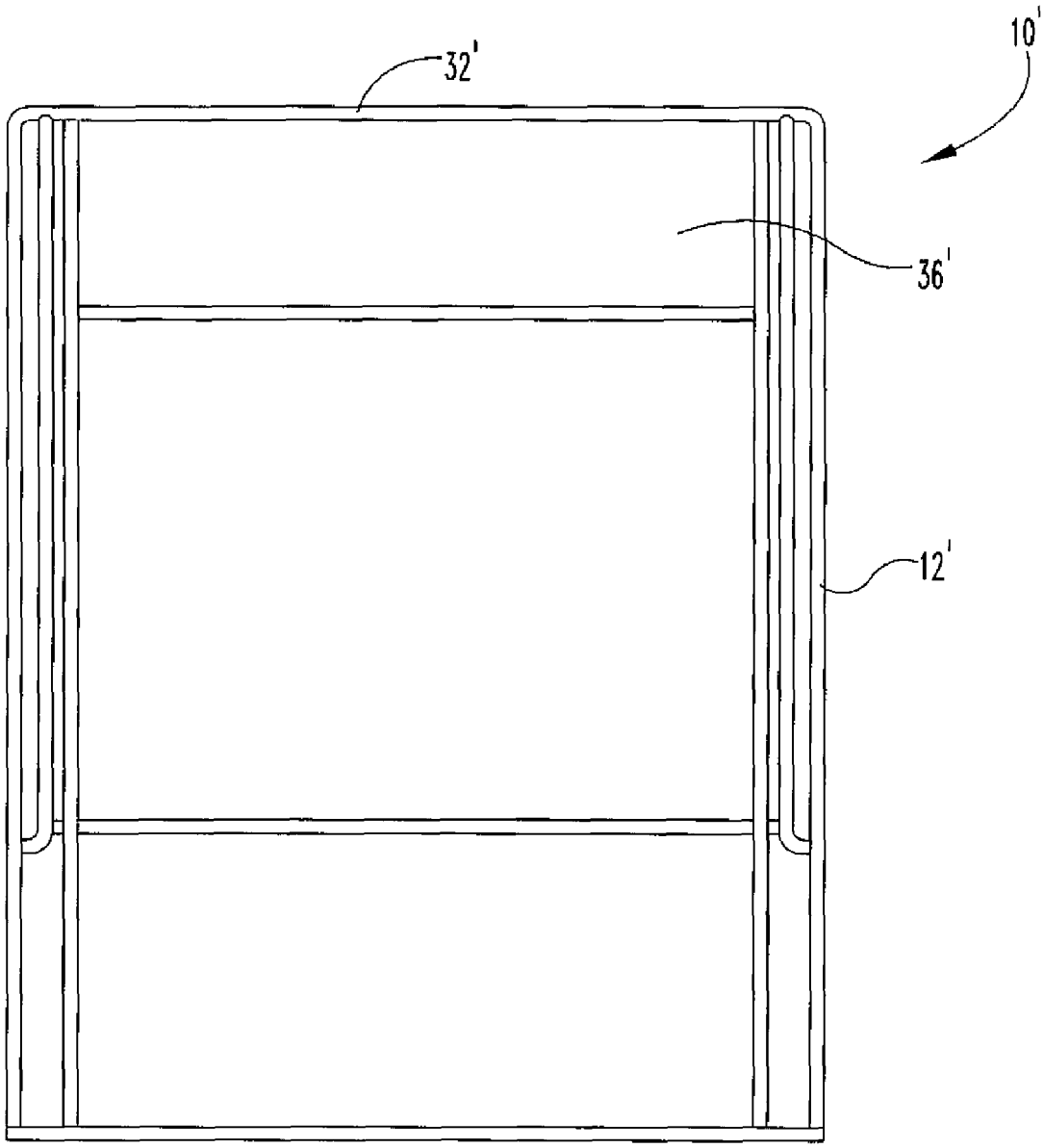
FIG. 16 is a front view of an alternative embodiment of the table of the present invention.
Figure 17:
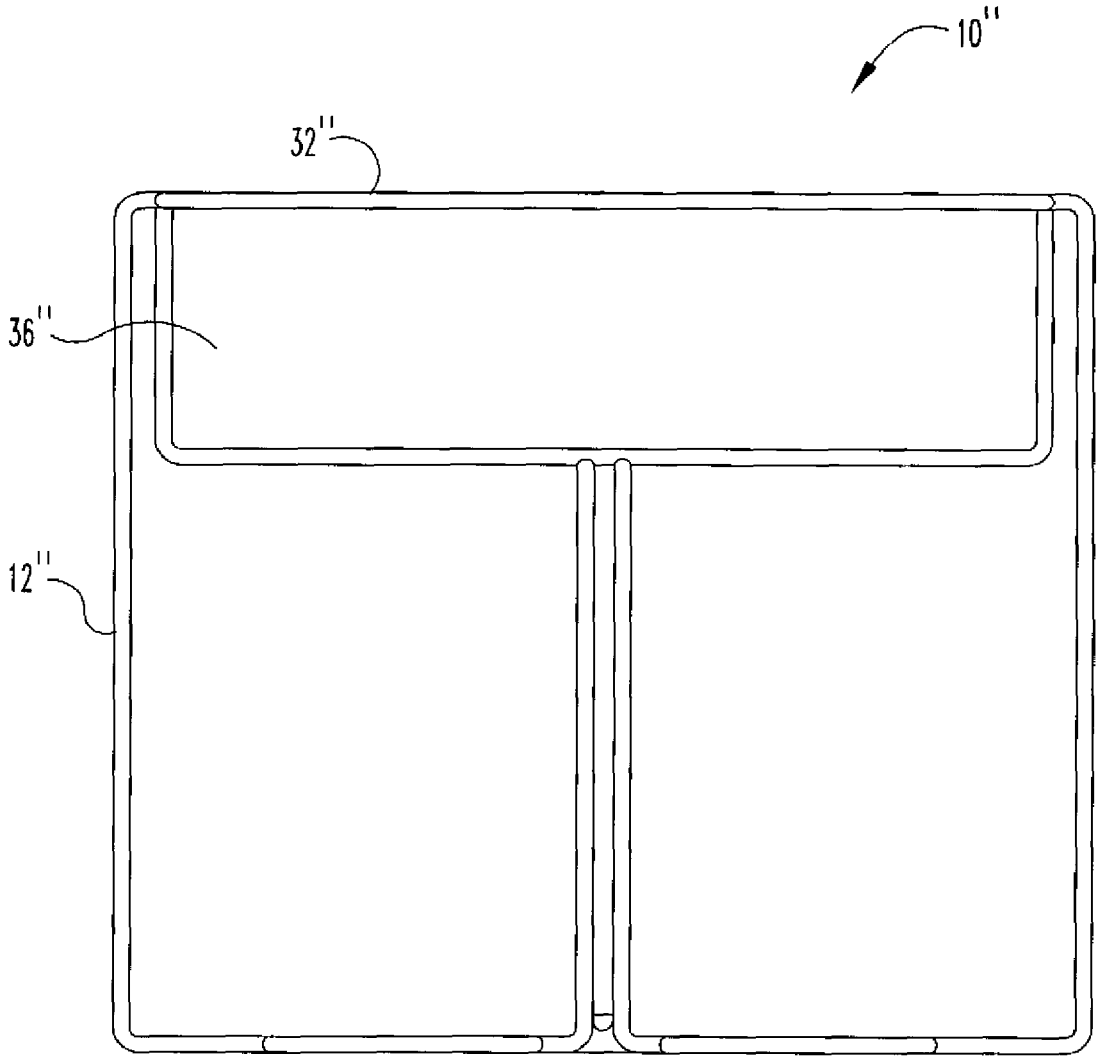
FIG. 17 is a front view of another alternative embodiment of the table of the present invention.

A stackable table 10 in accordance with one embodiment of the invention is depicted in FIG. 1. The table 10 may be used in a variety of facilities such as a classroom, conference room, church, or convention center to meet a variety of needs. The table 10 includes a wire frame base 12 of generally u-shaped construction to provide chair access and leg space within the frame. The wire frame base may be constructed from any wire or rod material, but is preferably of a 7/16 inch wire stainless steel or aluminum. The wire frame base 12 has a floor-engaging frame 12' that includes two base side bars 14, each connected at a first end 13 to a longitudinal back bar 16 to form a U-shape as shown in FIG. 1. Attached at a second end 15 of each side bar 14 is a front vertical support rod 24 which extends vertically upward. Each front vertical support rod 24 extends to approximately the height of the desired work surface or table top 32. A front cross member 26 (shown best in FIG. 2) may be provided which spans between the two front vertical support rods 24. Many heights of the table top 32 are contemplated, but in a preferred embodiment the height of the work surface is approximately 27-29 inches. In an alternative embodiment, a standard bar height may be approximately 42 inches as shown in FIG. 16. FIGS. 16 and 17 show alternative embodiments of the wire frame table 10', 10" of the present invention including different configurations of the wire frame base 12', 12", the modesty panel 36', 36" and of the height of the table top 32', 32". In one embodiment, the front cross member 26 is sized to provide a leg space between the vertical rods that is slightly larger than a typical stackable chair, an example of which is depicted in U.S. Pat. No. 6,722,735 to Lucci et al.

Figure 2:
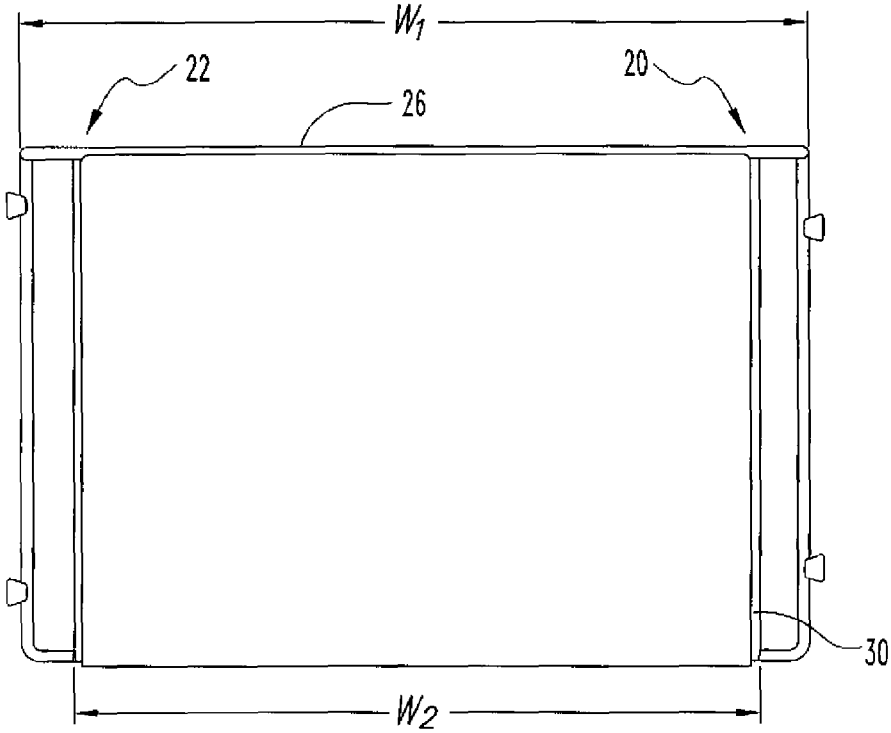
FIG. 2 is a top view of the wire frame table shown in FIG. 1.

Two back vertical support rods 28 are attached at one end 27 to the longitudinal back bar 16. These back vertical support rods 28 extend vertically upward from the longitudinal back bar 16 and are spaced from the front cross member 26 to accommodate the depth of a table top 32, with or without a modesty panel 36. The back vertical support rods 28 extend vertically upward and are each connected to an upper side bar 30. In one embodiment, the back vertical support rods 28 and the top side bars 30 are formed from the same length of wire material. The joint may be formed by bending the wire material at approximately an angle A of about 92 degrees. The upper side bars 30 may then be joined at the other end to the front cross member 26 by means of brazing, welding, bolting, or any other suitable joining method known in the art. As seen in FIG. 2, the upper side bars 30 join the front cross member 26 inboard from the base side bars 14 and vertical rods 24.

It should be noted that in a preferred embodiment, the joints of the wire members can be formed from bending the wire material. Thus, the wire frame base 12, front vertical support rods 24 and front cross member 26 may be formed from a single piece of wire material that has been formed by bending the wire into the desired skeleton.

Figure 4:
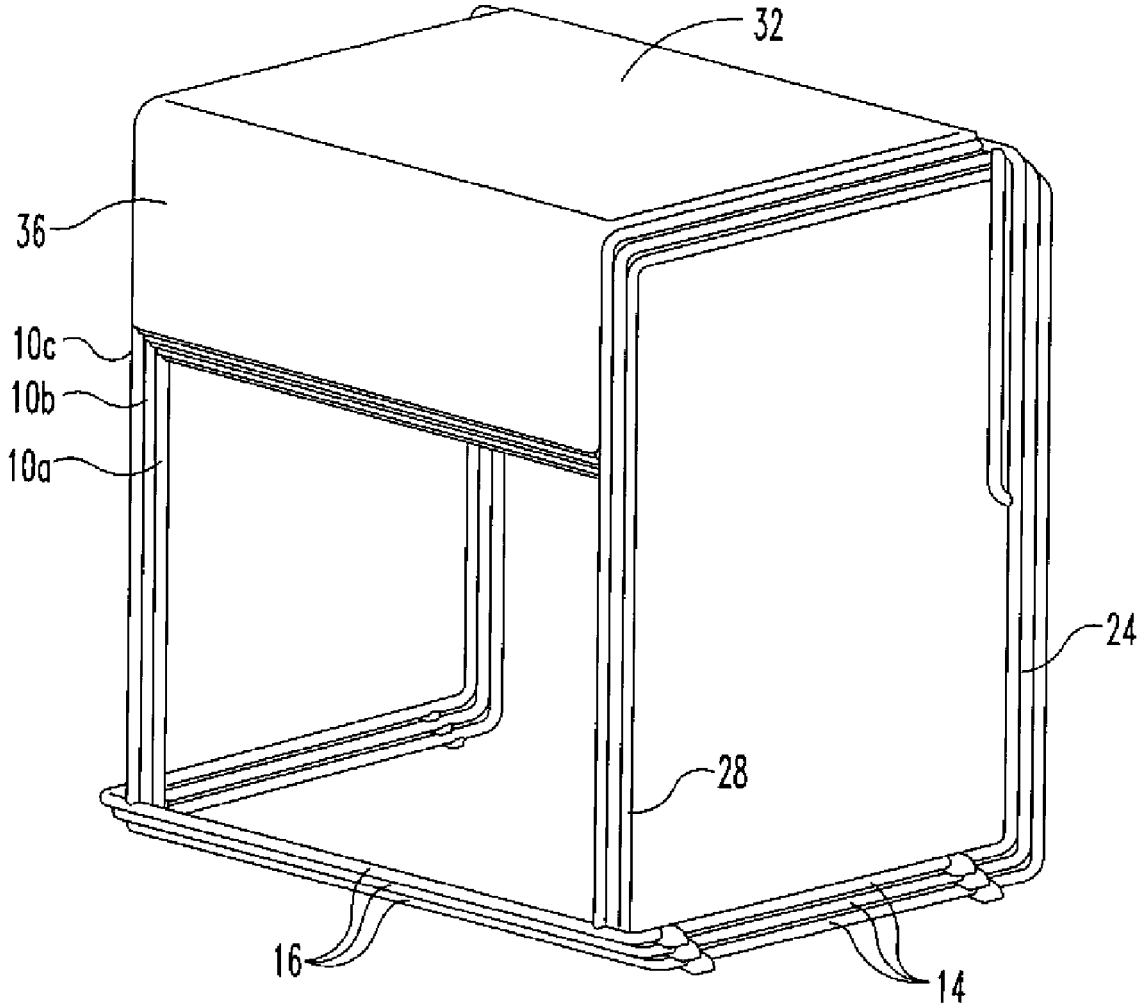
FIG. 4 is a front perspective view of three wire frame tables stacked and nested according to one embodiment of the invention.

FIG. 4 shows three stackable tables 10A, 10B, and 10C in a stacked and nested configuration suitable for storage. As is apparent from the figure, the tables may be stacked with the respective table tops 32 and modesty panels 36 in contact with each other. The tables may be stacked and nested in the following manner: A top table 10B is positioned adjacent a bottom table 10A by moving the top table 10B over the bottom table 10A. The front vertical supports 24 of the tables are spaced a distance W1 (FIG. 2) such that they pass around the back vertical supports 28 of the adjacent table which are spaced at lesser distance W2. The top table 10B is then moved forward until the frame members nest as shown in FIG. 4 with the base side bars 14 and back bars 16 resting on each other. The distance between the front vertical support rods W1 is greater than the distance between the back vertical support rods W2 which allows for the stackability/nestability of the tables as depicted in FIG. 4.

Figure 3:
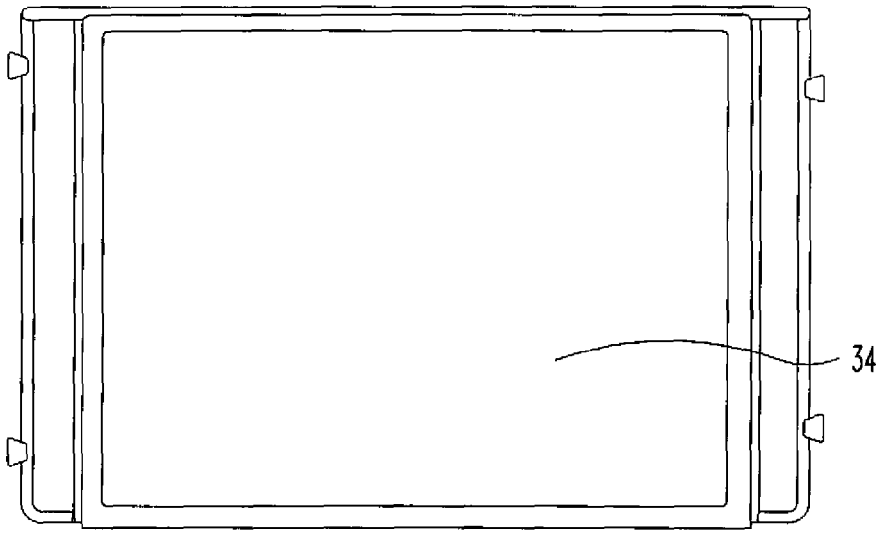
FIG. 3 is a top view of a further embodiment of the wire frame table shown in FIG. 1.

In a particular embodiment, the table top 32 is of generally rectangular construction as shown in FIG. 2 to provide a usable work surface for the table. In one embodiment, the table top 32 may incorporate a slightly recessed surface 34 for containing or retaining pens and pencils on the table top, as illustrated in FIG. 3. Similarly, grooves for holding pens/pencils (not shown) or grooves/holes for holding drinking cups (not shown) may be formed into the table top in any suitable manner known in the art, so long as the stackability/nestability of the tables is not impaired. The table top has any depth suitable for a particular use. In one embodiment, the depth of the table top 32 is approximately 19 inches; however, alternative depths are also contemplated by this invention.

In another feature of the invention, a modesty panel 36 of generally rectangular construction is disposed between the back vertical support rods 28 as shown in FIG. 1. This invention contemplates many lengths of the modesty panel 36. In one embodiment, the modesty panel 36 extends down from the table top 32 toward the longitudinal back bar 16, or may extend a shorter distance. According to convention, the modesty panel 36 may extend approximately eight inches from the table top 32. Like the support rods, the modesty panel 36 is also angled slightly to provide stability when the tables are stacked/nested as shown in FIG. 4. In one embodiment, the angle between the table top and the modesty panel A is approximately 92 degrees, though other angles are acceptable.

Figure 15:
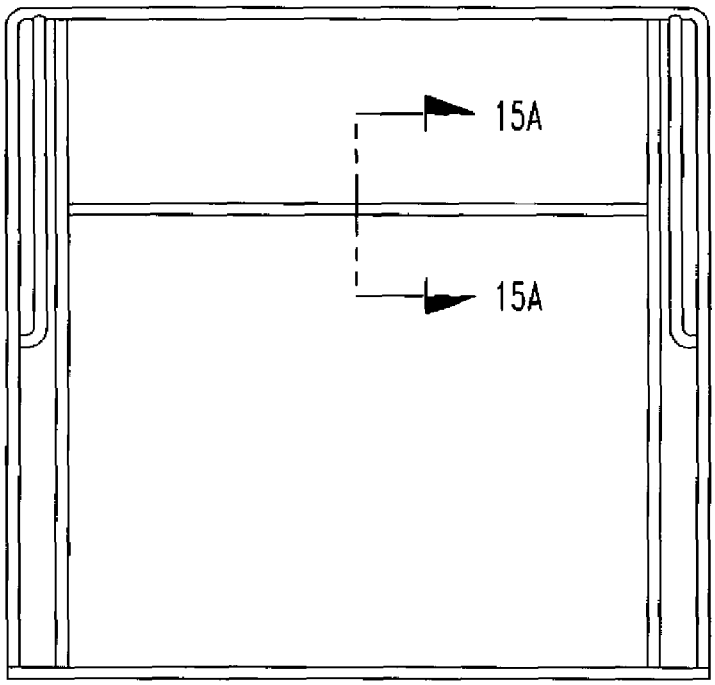
FIG. 15 is a cross-sectional view of a snap fit arrangement between the modesty panel and modesty panel support bar according to one embodiment of the wire table of the present invention.
Figure 15A:
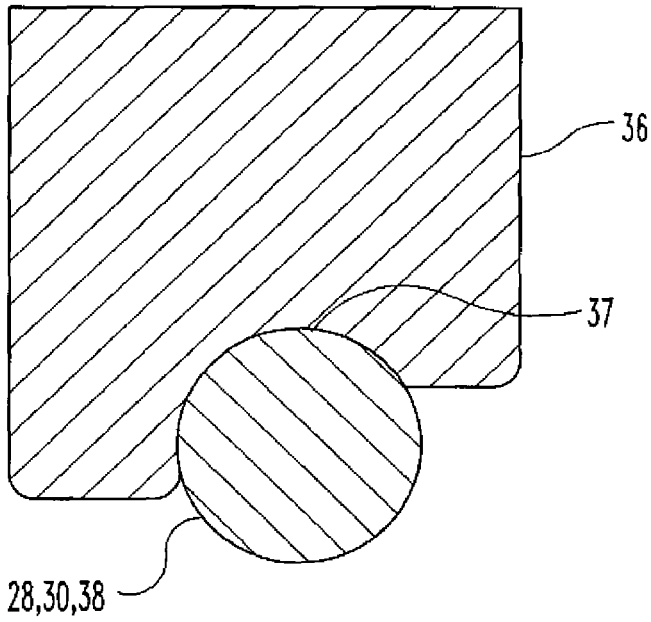

In one embodiment, the table top 32 and modesty panel 36 are of unitary construction. The unitary top/panel 32/36 may then be snap fit into place at a channel 37 shown in FIG. 15, on the edge of the unitary panel that fits the tubular material of the vertical supports 28 and side bars 30. If the modesty panel 36 does not extend to the longitudinal back bar 16, a modesty panel cross bar 38 (shown in FIG. 1) may be utilized with the snap fit design. The modesty panel cross bar 38 could be made from the same wire material and span the width of the two back vertical supports 28 such that the bottom of the modesty panel 36 can engage the cross bar 38. Other methods of joining the table top 32 and modesty panel 36 to the frame 12 are contemplated including any suitable means known in the art such as welding, riveting, gluing, etc.

In order to enhance the fixation of the table top 32 to the wire frame of the table, at least one of the back vertical supports 28 and the associated upper side bar 30 may be canted inward at a slight angle so that the distance between the opposite upper side bars 30 decreases slightly from the front of the frame to the back. When the table top is positioned between the upper side bars 30 and back vertical supports 28, the one back vertical support must be pushed outward enough for the table top 32 to fit between the bars. The natural spring resistance of the canted back vertical support will help hold the table top in position.

Alternatively, both back vertical supports 28 and associated upper side bars 30 may be canted inward from the vertical front-back plane. With this configuration, the table top 32 will have a slightly trapezoidal shape from front to back. In a specific embodiment, the inward cant may be at an angle of about 89 degrees.

Figure 5:
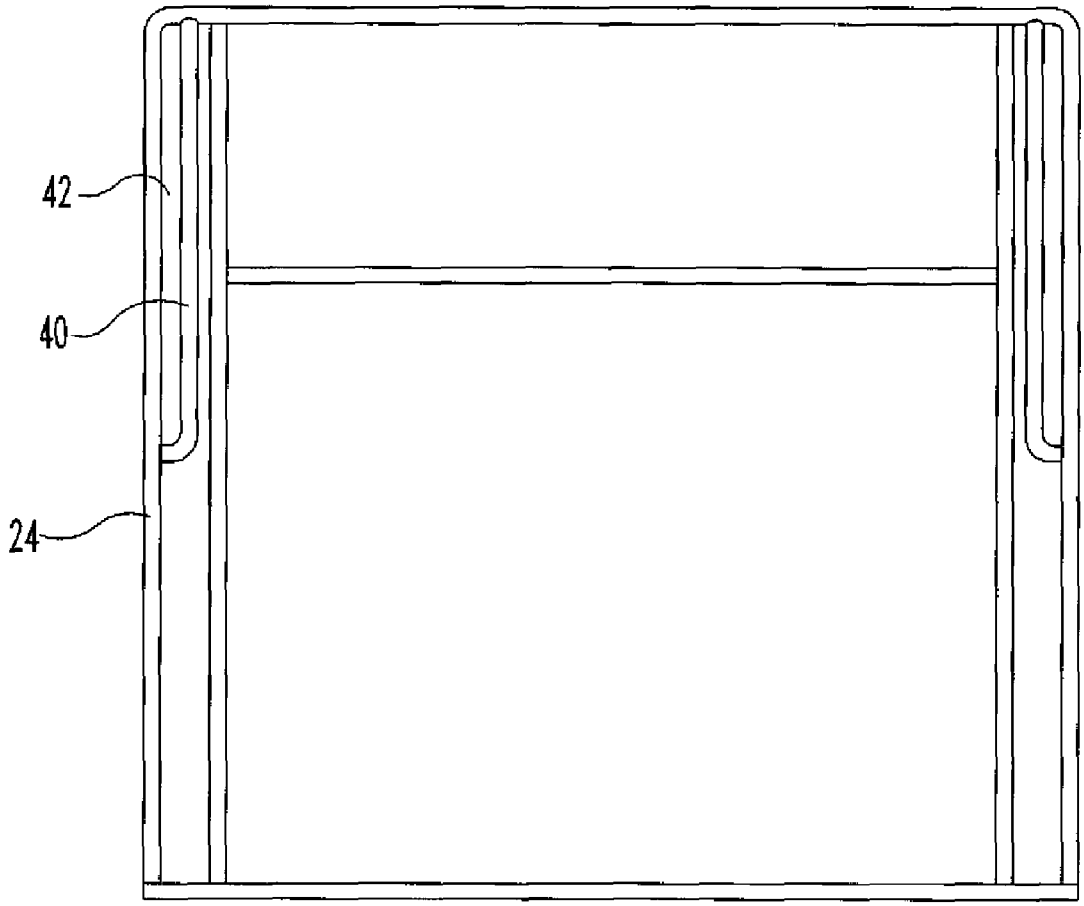
FIG. 5 is a front view of the wire frame table shown in FIG. 1.
Figure 11:
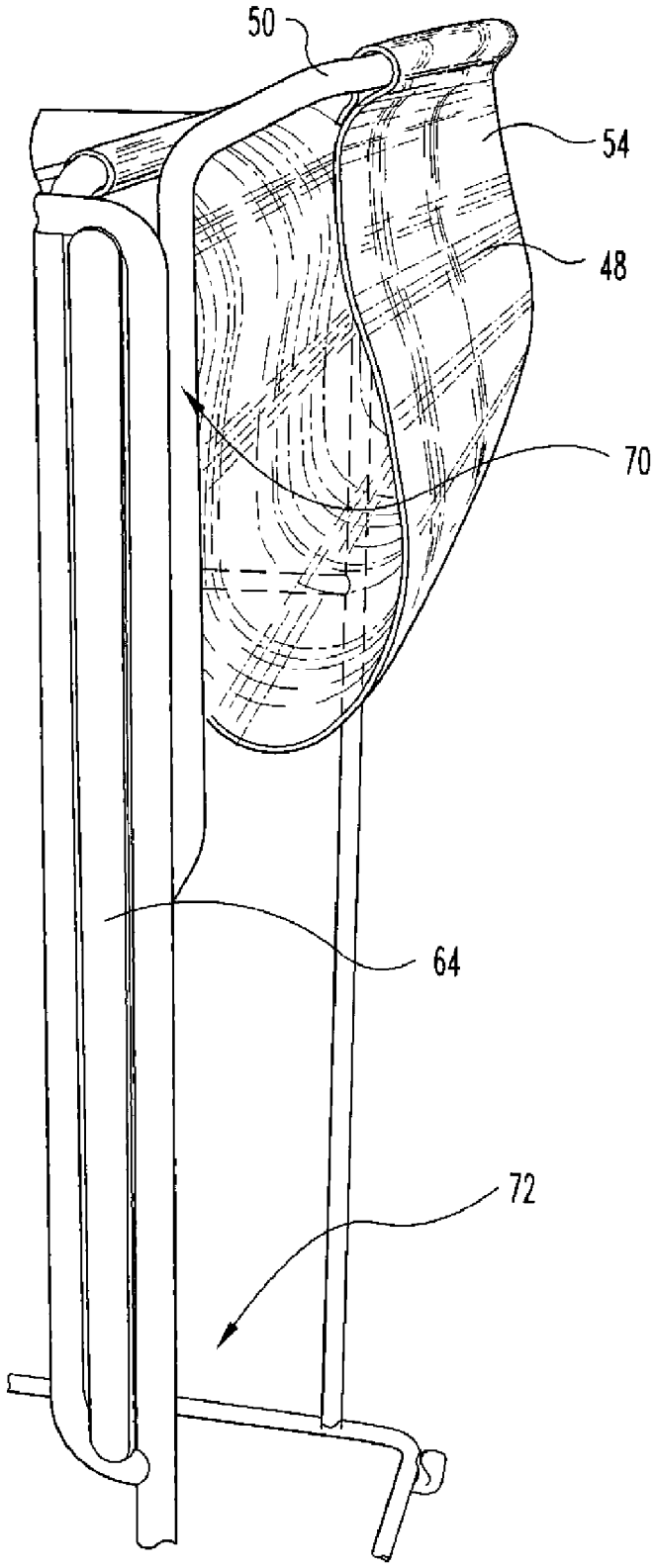
FIG. 11 is a side perspective view of the carrier pouch accessory for use with table shown in FIG. 1.
Figure 12:
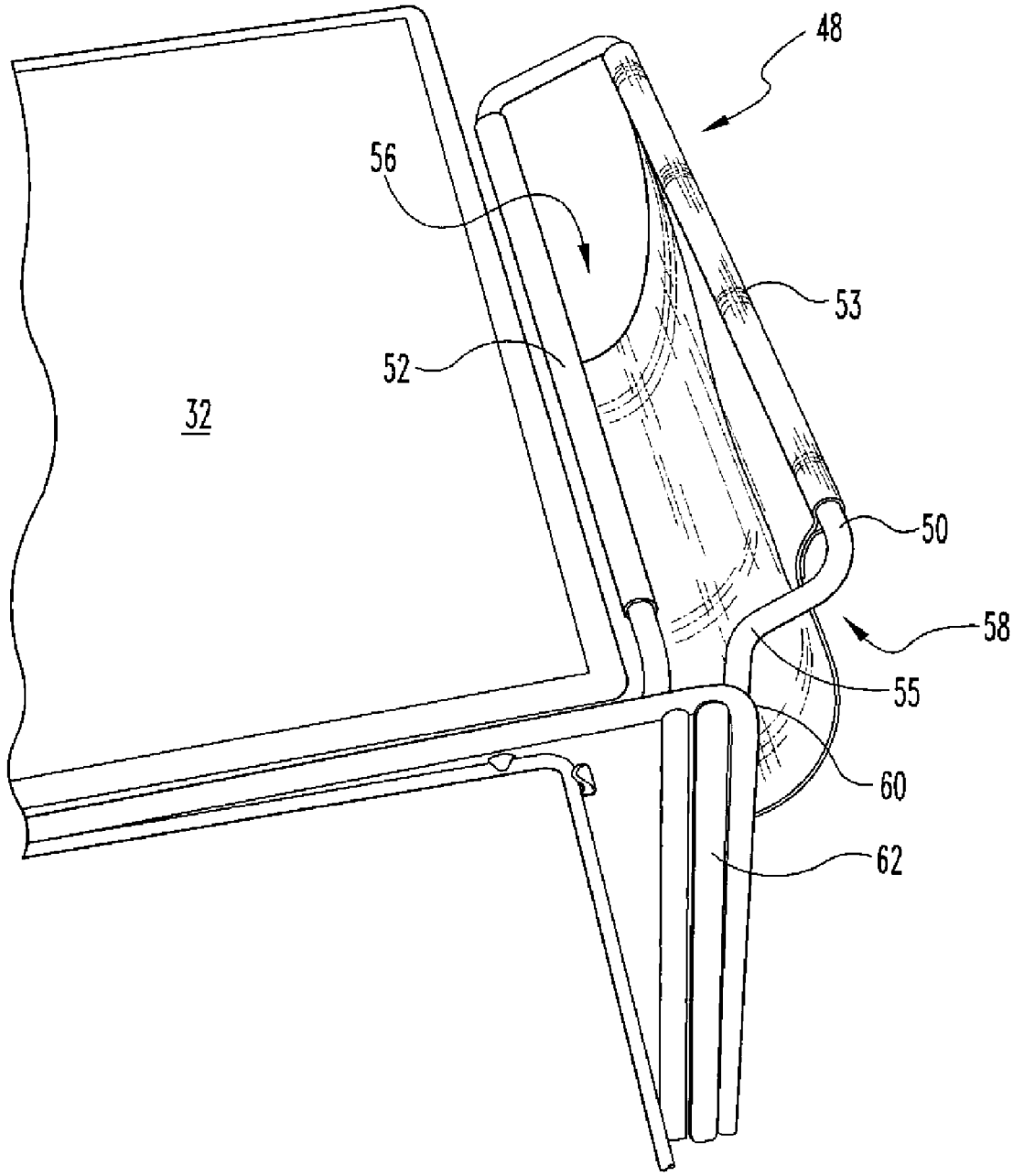
FIG. 12 is a top perspective view of the carrier pouch shown in FIG. 11.

In another feature of the invention the wire table defines an accessory opening 42 by joining an accessory bar 40 to the front vertical support rods 24 as shown in FIGS. 1 and 5. It can be appreciated that the accessory opening 42 could be constructed on either side of the table, or both. The accessory bar 40 is spaced apart from the front vertical support rod 24 so as to define the opening 42 for mounting accessories. In one embodiment, the opening 42 is formed as an elongated slot, although other shapes of openings may be contemplated. The accessory opening 42 as shown in FIG. 5 can be used to support a hanging bracket 62 by means of a cantilever arm 60, as illustrated in FIGS. 11-12, which will be described in more detail later herein.

In a further feature, the table 10 may include glide members 44 that support the table while providing a ganging capability. The glide members 44 are located on the wire frame base 12 as shown in FIG. 1. In a preferred embodiment, two glide members 44 are spaced apart on each side bar 14 of the wire base frame 12. As shown in the detail views of FIGS. 6-8, one portion 41 of the glide members 44 is configured for mounting to the side bar 14 by at least partially wrapping around the geometry of the side bar 14. In one embodiment, where the wire frame base 12 is of a wire construction, the glide member 44 is configured to receive the wire frame in a channel 46 sized to receive the wire material.

Figure 6:
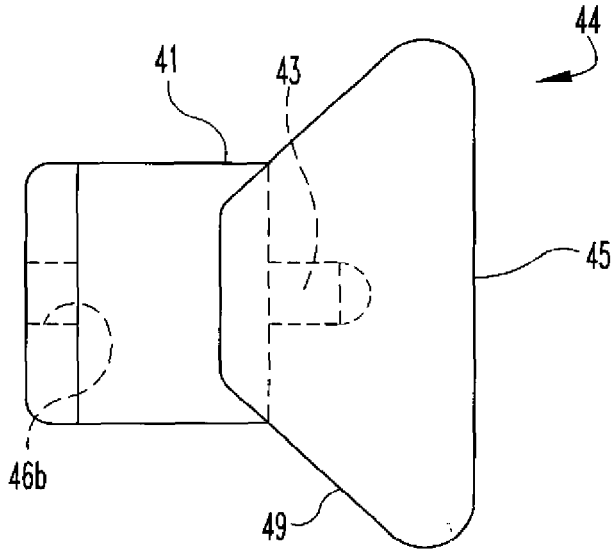
FIG. 6 is a top view of a glide member used with the table shown in FIG. 1.
Figure 8:
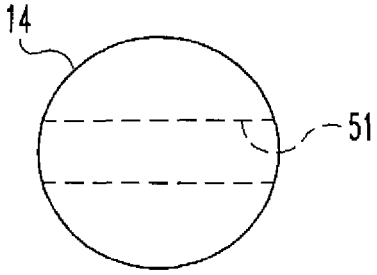
FIG. 8 is a cross-sectional view of the wire frame where the glide member shown in FIG. 6 attaches.
Figure 7:
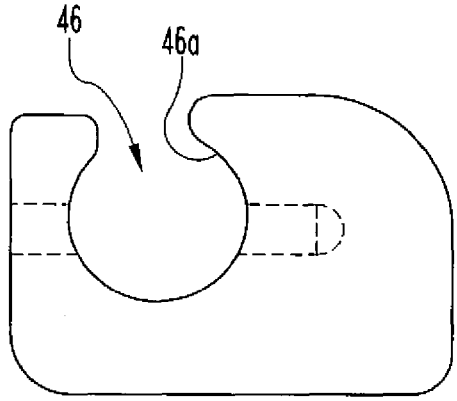
FIG. 7 is a cross-sectional view of the glide member shown in FIG. 6.

In another embodiment, a secondary mechanism may be employed for securing the glide member 44 to the side bar 14. For instance, one embodiment uses a screw 43 inserted through a hole 51 in the side bar 14 at the desired locations for positioning of the glide members, as shown in FIG. 8. The channel 46 of the glide member 44 thus includes a portion 46*a* to receive the side bar 14, and a portion 46*b* configured to receive the screw 43, as shown in FIGS. 6 and 7. The screw 43 helps position the glide member 44 on the frame and hold the glide member 44 in place during use. If the glide member 44 becomes worn or damaged it can be easily removed and replaced. In alternative embodiments, the screw 43 may be a spring pin that is initially depressed to mount the glide member 44 on the frame.

Figure 9:
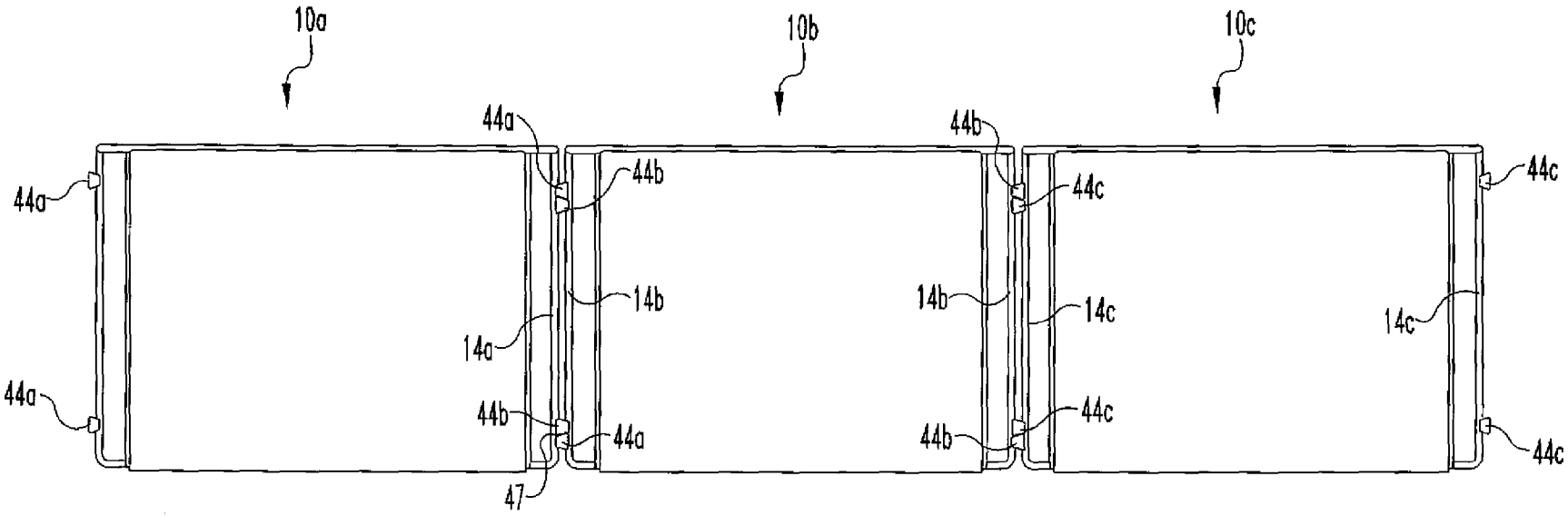
FIG. 9 is a top view of three wire frame tables ganged according to one embodiment of the invention.

The second portion 45 of the glide member 44 is of a generally trapezoidal configuration. This shape provides a unique advantage when two or more tables are ganged together. In order to take advantage of the configuration of the portion 45, the glide members 44 are located at offset positions on the opposite side bars 14 such that when two or more tables are placed side by side, as shown in FIG. 9, the glide members 44 perform not only a spacing function, but also function to hold the consecutive tables in relative position. That is, the glide members 44 are located such that when two tables are placed next to each other, the angled edges 49 of the trapezoid shape 45 juxtapose to form a "dovetail" joint 47. The alignment of the glide members 44 as depicted in FIG. 9 is such that the glide members 44*b* attached to side bar 14*b* (of the second table 10*b*) are offset relative to the glide members 44*a* attached to side bar 14*a* (of the first table 10*a*). Similarly, the glide members 44*c* attached to side bar 14*c* are offset relative to those attached to side bar 14*b*. In a preferred embodiment, the glide members are arranged so that the glide members on side bar 14*a* surround the glide members on the juxtaposed side bar 14*b*.

Figure 10:
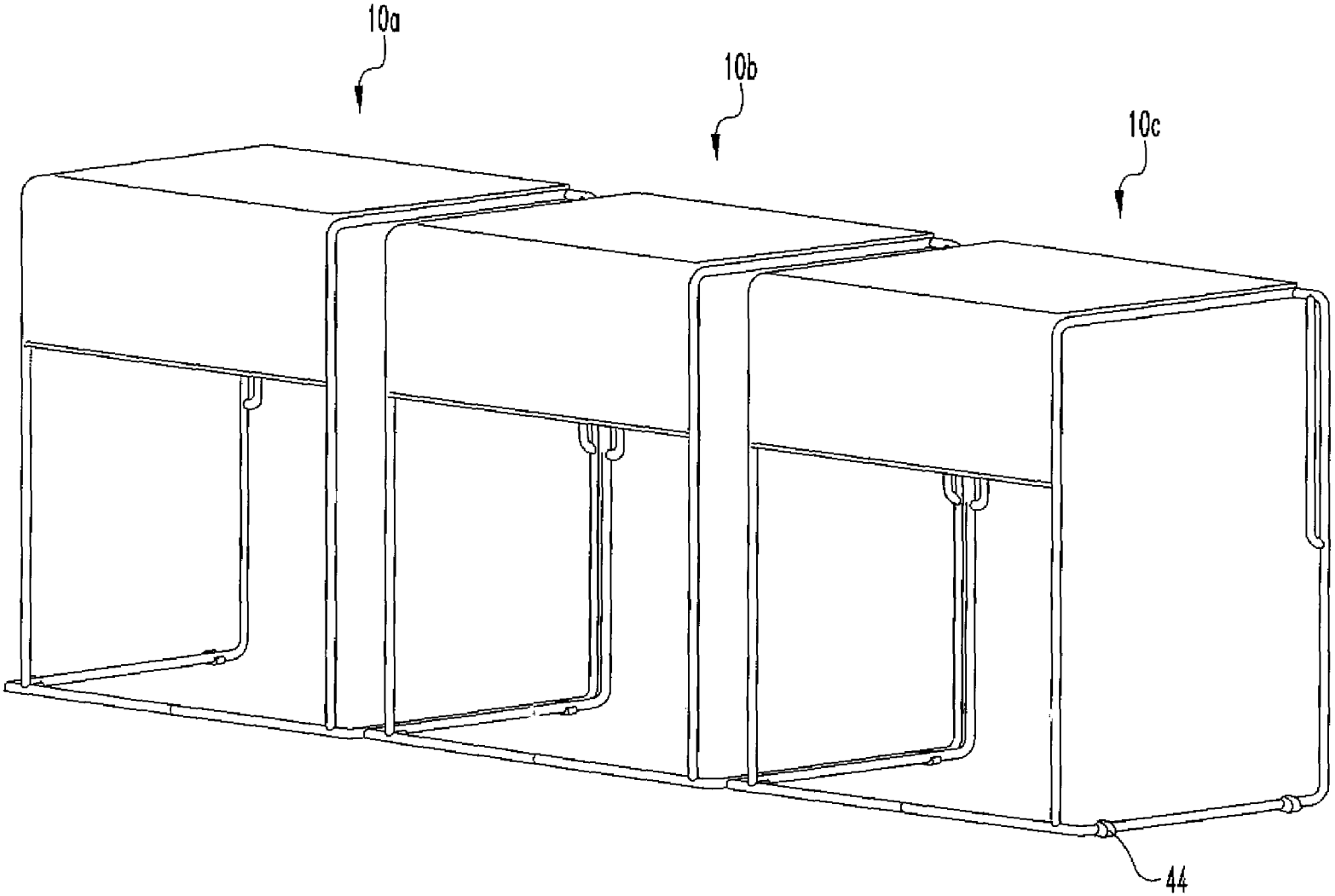
FIG. 10 is a front perspective view of three wire frame tables ganged according to one embodiment of the invention.

This feature provides many advantages. First, the glide member 44 works to evenly space each table 10 apart from the next when the tables are ganged in rows as shown in FIG. 10. Similarly, the engagement of the glide members 44 to one another prevents the tables from skewing. The "dovetail" joint 47 formed by the adjacent glide members 44, provides an aesthetically pleasing arrangement for several tables with minimal effort. In one embodiment, the glide members are formed from a polycarbonate, but many suitable materials are contemplated by this invention.

Figure 13:
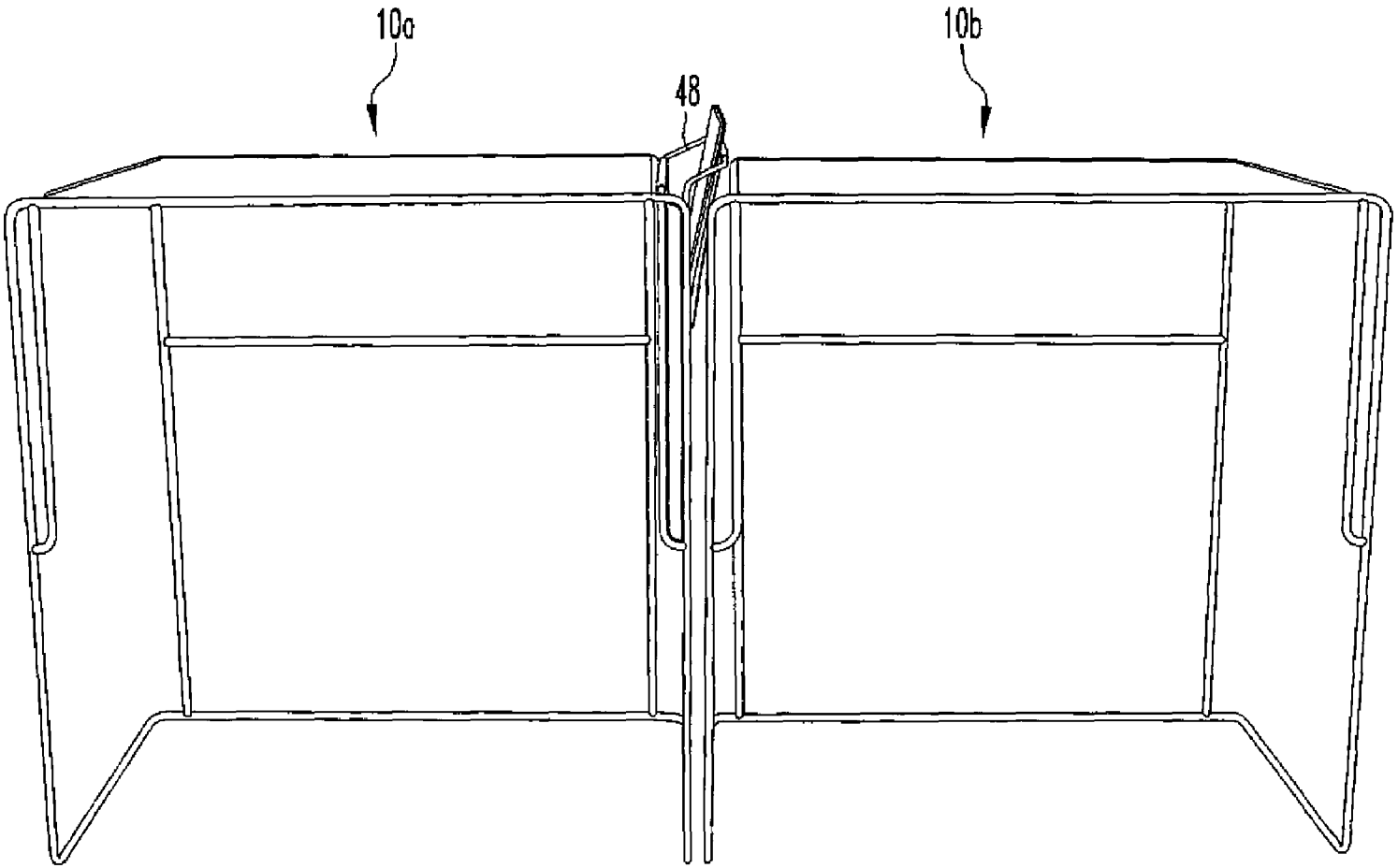
FIG. 13 is a front perspective view of two ganged tables of the present invention and the receptacle pouch shown in FIG. 11.

As alluded to above, another feature of the table 10 is the side storage carrier or pouch 48, illustrated in FIGS. 11-14, that is configured to receive books, folders, or other supplies that might otherwise clutter the table top 32. In one embodiment, the side storage receptacle pouch 48 is formed from a wire frame 50. The wire frame 50 is of a generally rectangular construction and is preferably sized such that when the tables 10 are ganged, the wire frame 50 will fit inside the space between the table tops 32 as shown in FIG. 13. A rectangular piece of material 54, preferably of a knit or woven mesh, is secured to the longitudinal edges 52, 53 of the wire frame 50 forming a pouch 56 sized to receive books, folders, training materials, etc. In one embodiment, the longitudinal edge 53 of the wire frame 50 that is disposed farthest from the table top 32 is elevated with respect to the other longitudinal edge 52. It can be appreciated that when tables 10 are grouped together in rows, this raised edge 53 will help delineate the workspace or personal space for each table 10 as shown in FIG. 13.

Figure 14:
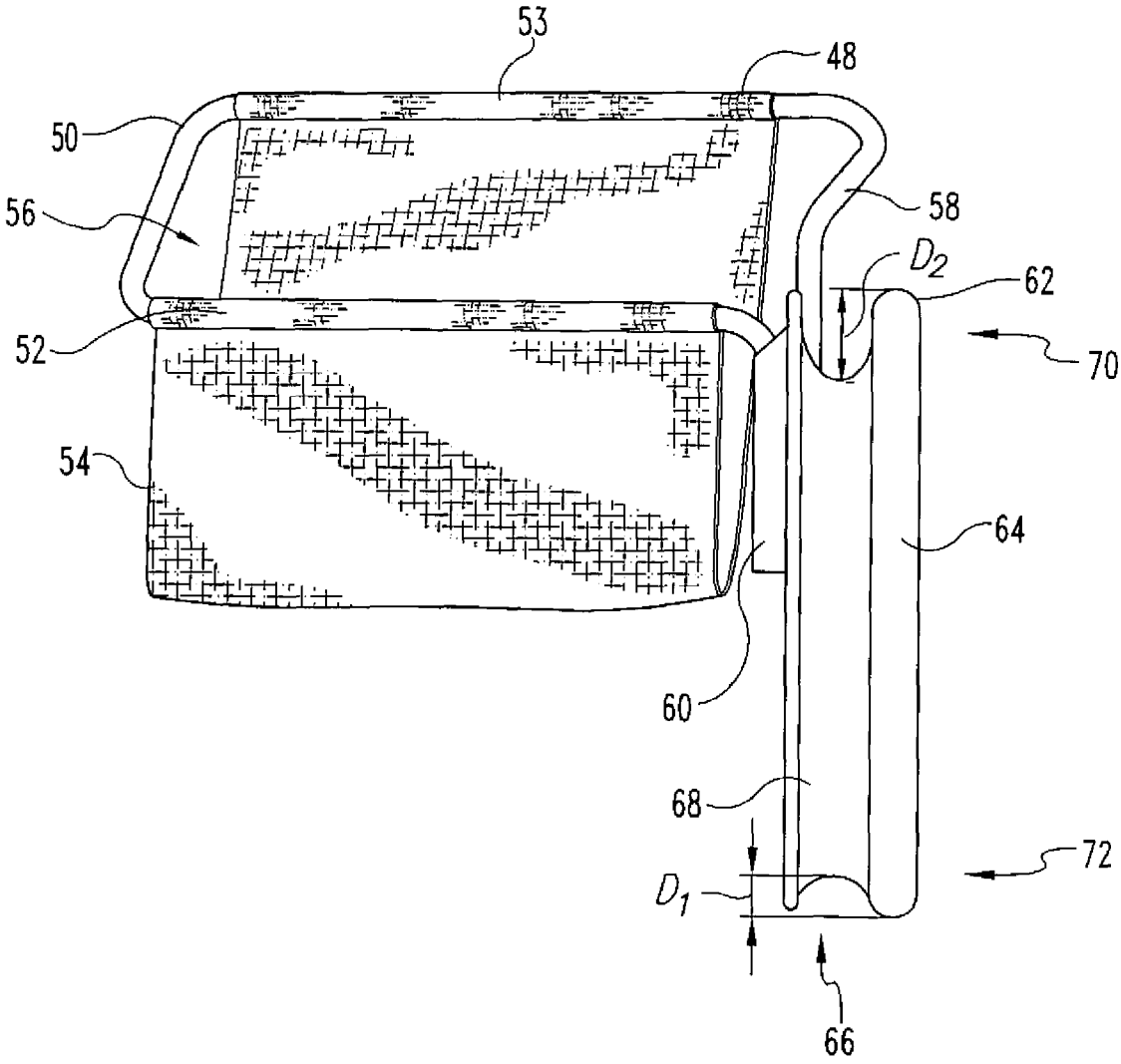
FIG. 14 is a side perspective view of the carrier pouch shown in FIG. 11.

As best seen in FIG. 14, the wire frame 50 terminates at a lateral edge 58 in a cantilever arm 60. In a preferred embodiment, the ends 55 of the wire frame 50 are formed into the arm 60 from a continuous piece of material, such as a steel or aluminum tube. In an alternative embodiment, the arm 60 may be attached to the wire frame 50 of the side storage pouch 48 by any suitable method. The arm 60 is connected or attached to a hanging bracket 62 that is used to support the arm 60 on the wire table 10. The hanging bracket 62 is generally elongated, as shown in FIG. 13, with an oval member 64 that is configured to be received into the accessory opening 42 of the table 10. In a preferred embodiment, the oval member 64 defines a groove 66 formed on the outside perimeter 68. This groove 66 is deeper at the top end 70 than at the bottom end 72 of the oval member 64. The differences in the depth (D1, D2) of the groove 66 allows the hanging bracket 62 to be easily mounted into or removed from the accessory aperture 42 with no tools. To mount the hanging bracket 62, and thus the accessory 48 attached to it, the top end 70 of the oval member 64 is inserted into the accessory opening 42. The hanging bracket 62 is then angled into place as shown in FIG. 12, and the bottom end 72 of the oval member 64 is seated on an edge of the accessory bar 40 with the weight of the accessory holding it in place. Reversal of this procedure allows for removal. It can be appreciated that other accessories, such as shelves, partitions, storage bins, etc, may be used with the hanging bracket 62.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A table comprising:

a wire frame including;

two front vertical supports spaced apart a first distance; and two back vertical supports spaced apart a second distance less than said first distance;

a table top supported by said wire frame said table top having a front end adjacent said front vertical supports and a back end adjacent said back vertical supports and having a substantially constant width between said front end and said back end that is substantially equal to said second distance; and a modesty panel supported by said vertical supports and disposed between said back vertical supports.

2. The table of claim 1, wherein said modesty panel is disposed at an obtuse angle with respect to said table top.

3. The table of claim 2, wherein said obtuse angle is approximately 92 degrees.

4. The table of claim 2, wherein said modesty panel is integral with said table top.

5. The table of claim 1, wherein said wire frame further includes a U-shaped floor-engaging frame connecting said front vertical supports to said back vertical supports and configured to be supported on a floor.

6. The table of claim 5, wherein said floor-engaging frame includes:

opposite side bars connected to a corresponding one of said front vertical supports; and a rear bar connected between said opposite side bars, and further wherein said back vertical supports are connected to said rear bar inboard of said side bars.

7. The table of claim 1, wherein:

said wire frame includes a front cross member spanning between said front vertical supports; and said table top is supported by said front cross member.

8. The table of claim 7, wherein:

said wire frame further include opposite upper side bars connected between a corresponding one of said back vertical supports and said front cross member inboard of said front vertical supports; and said table top is supported by said upper side bars.

9. The table of claim 7, further comprising an accessory bar connected to at least one of said front vertical supports and said front cross member, wherein said accessory bar, said at least one of said front vertical supports and said front cross member define an elongated opening.

10. A table comprising:

a wire frame including;

two front vertical supports spaced apart a first distance;

two back vertical supports spaced apart a second distance less than said first distance; and a cross bar spanning between said back vertical supports;

a table top supported by said wire frame said table top having a front end adjacent said front vertical supports and a back end adjacent said back vertical supports and having a width between said front end and said back end that is substantially equal to said second distance; and a modesty panel supported by said vertical supports and disposed between said back vertical supports;

wherein said cross bar is vertically offset from said table top and said modesty panel includes a lower edge connected to said cross bar.

11. The table of claim 10, wherein said modesty panel is disposed at an obtuse angle with respect to said table top.

12. The table of claim 11, wherein said obtuse angle is approximately 92 degrees.

13. The table of claim 11, wherein said modesty panel is integral with said table top.

* * * * *